US005725224A

United States Patent [19]

Kerr

[11] Patent Number: 5,725,224

[45] Date of Patent: Mar. 10, 1998

[54] LOWER LEG ROLLING APPARATUS

[76] Inventor: David R. Kerr, 64 Braeburn Rd., Hyde Park, Mass. 02136

[21] Appl. No.: 534,222

[22] Filed: Sep. 26, 1995

[51] Int. Cl.[6] ..... A63C 17/00

[52] U.S. Cl. ..... 280/11.19; 280/32.5; 280/87.021

[58] Field of Search ..... 280/30, 32.5, 87.01, 280/87.021, 87.041, 87.042

[56] References Cited

U.S. PATENT DOCUMENTS

| | | | |
|---|---|---|---|
| 1,348,683 | 8/1920 | Aldenbruck et al. | 280/32.5 |
| 2,448,427 | 8/1948 | Gordon | 280/32.5 |
| 2,484,494 | 10/1949 | Ferguson | 280/87.021 |
| 3,567,242 | 3/1971 | Miller | 280/87.041 |
| 4,167,225 | 9/1979 | Fragaso | 280/87.042 |
| 4,190,261 | 2/1980 | Moutz | 280/87.01 |
| 4,336,952 | 6/1982 | Rochman | 280/87.01 |
| 4,930,796 | 6/1990 | Harrod | 280/87.021 |
| 4,951,958 | 8/1990 | Chao | 280/87.041 |
| 5,380,021 | 1/1995 | Doherty | 280/32.5 |
| 5,427,391 | 6/1995 | Cooper | 280/87.021 |

FOREIGN PATENT DOCUMENTS

| | | | |
|---|---|---|---|
| 631170 | 11/1978 | U.S.S.R. | 280/87.041 |

*Primary Examiner*—Richard M. Camby
*Assistant Examiner*—Frank Vanaman

[57] ABSTRACT

The invention pertains to a rolling apparatus which is used when secured to the lower leg of a person. The rolling apparatus is comprised of 1) an elongate body portion with front and rear ends, and also presenting planar upper and lower surfaces; 2) a plurality of roller trucks secured to the lower surface of the elongate body portion, positioned adjacent opposite front and rear ends thereof; and 3) a means of securing the upper planar surface of the elongate body portion to the lower leg of the person.

9 Claims, 4 Drawing Sheets

LOWER LEG ROLLING APPARATUS

BACKGROUND

In the twentieth century, a number of inventions have been discovered and used for unmotorized movement or transportation of individual people. These inventions include push carts, rollers skates, skateboards and most recently, ROLLER BLADES™ in lines skates. The use of these inventions, however, is always accompanied by the inconvenience of having to use the invention without simultaneously having the abilty to use an individual's legs for walking. For example, with roller skates, a person must carry the skates to the place where they are to be used, remove their shoes and place on their skates. While the skates are on, the person is significantly limited in his or her ability to manuver as they could without skates. To walk again, he or she must remove the skates and in most cases carry the skates back to their car or home. The same is true with skateboards. When not in use, a person must pick up the skateboard to be able to walk to or in a place where use of a skateboard is not appropriate or allowed. ROLLER BLADES™ in line skates present a similar problem, in that, many places such as stores and public buildings will not allow their use inside for reasons of potential legal liability, should the person using ROLLER BLADES™ in line skates fall and become injured or injure someone else.

The problem of dealing with recreational mobility or transportation devices has even led to the discovery and parenting of devices to carry these inventions, as in U.S. Pat. No. 5,344,056.

The discovery of a device which would allow a type of recreational movement similar to roller skating, skateboard or using ROLLER BLADES™ in line skates, while simultaneously allowing the ability to walk without having to remove the device from one's person and then carry the device would represent a significant advantage to individuals who wish to enjoy this type of activity.

In addition, there is undoubtedly, a need for such a device in many work related environments, as well. Many workpeople spend much of their time on their knees or in a squatted position, such as workers who lay down flooring and rugging. These workers would find a device, greatly advantageous in their work setting, which allowed them mobility in a squatted or kneeling position, while at the same time allowing them the ability to immediately stand and walk without having to remove the device.

SUMMARY OF THE INVENTION

The present invention pertains to a rolling apparatus which is used when secured to the lower leg of a person. The rolling apparatus is comprised of 1) an elongate body portion with front and rear ends, and also presenting planar upper and lower surfaces; 2) a plurality of roller trucks secured to the lower surface of the elongate lower portion, positioned adjacent opposite front and rear ends thereof; and 3) a means of securing the upper planar surface of the elongate body to the lower leg of the person. The elongate body of the rolling apparatus can be adjusted in length to accommadate people of varying heights.

Other embodiments of the present invention include the rolling apparatus as described above to which a padding apparatus is attached or combined with the upper planar surface of the elongate body. In addition, other embodiments include means of braking the rolling apparatus comprising a foot pad attached to the rear end of the elongate body of the rolling apparatus and a mechanical lever attached to the side of the rolling apparatus which is engaged manually by the operator. Further, a means of steering the rolling apparatus is also provided.

The advantage of the present invention over the prior art allows a person or operator of the rolling apparatus the enjoyment of a recreational activity very similar to roller skating, skateboarding and using ROLLER BLADES™ in line skates while at the same time retaining the immediate ability to use one's feet and legs for walking without having to remove the device.

Another advantage of the present invention includes the freedom of not having to carry the device when not using the device. The rolling apparatus remains attached to one's lower legs and therefor there is no need for the device to be carried in one's arms, as is required with roller skates, skateboards and ROLLER BLADES™ in line skates. Thus, a greater degree of freedom is available to the operator of the present invention, in that, they can be using the device one moment and walking into a store or public building the next moment.

Further, the present invention provides a great advantage to workers who spend a significant portion of their working activities in a kneeling or squatted position. When using the present invention, a working operator can have mobility while in a kneeling or squatted position and at the same time retain the ability to stand and walk without having to remove the rolling apparatus.

BRIEF DESCRIPTION OF THE DRAWINGS

Figure One represents an illustration of a rolling apparatus in attachment to an operator in a standing position capable of walking (1A) and when in position to use the rolling apparatus.

Figure Two represents an illustration of the detailed structure of a rolling apparatus, including but not limited to, an elongate body, roller trucks, a braking foot pad, a steering mechanism, padding apparatus and a securing means for attachment to an operator.

Figure Three represents an illustration of the side view of a rolling apparatus, including but not limited to, the steering mechanism in various positions and the length adjustment knob.

Figure Four represents an illustration of an underside view of the rolling apparatus, including but not limited to, a means for adjusting the length of the elongate body.

Figure five represents an illustration of a side view of the rolling apparatus, including but not limited to, an alternate breaking means.

DETAILED DESCRIPTION OF THE INVENTION

General

The present invention pertains to a rolling apparatus which provides mobility for individuals in a kneeling or squatted position. The apparatus is used for recreational purposes, as well as, for activities in a working environment. The rolling apparatus is used when secured to the lower leg or shin of an individual. The rolling apparatus is comprised of 1) an elongate body portion with front and rear ends, and also presenting planar upper and lower surfaces; 2) a plurality of roller trucks secured to the lower surface of the elongate body portion, positioned adjacent opposite front and rear ends thereof; and 3) a means of securing the upper planar surface of the elongate body portion to the lower leg of an individual.

The rolling apparatus, as a whole, can be considered to be a carriage with a means for securement of the carriage to the shin of an individual or person. A carriage is defined as a wheeled support carrying a burden or weight.

Elongate Body Portion

The elongate body portion of the rolling apparatus is a two-sided platform which on one side provides an area of attachment to an individuals lower leg and on the opposite side provides areas where roller trucks can be mounted. The elongate body portion can be constructed of wood, plastic or metal, in whole or in part, and can be solid or hollow. The shape of the elongate portion can be rectangular and oblong and must be of such a dimension as to allow the attachment of two rolling apparatuses to an individual, one apparatus for each leg. The length of the elongate body portion of a rolling apparatus can be between 0.5 and 4.0 feet, with a perferred length of 2.0 feet. The width of the elongate body portion can be uniform or variable along its length.

The attachment means of the rolling apparatus are typically mounted on the sides of the elongate body portion. Means for controlling the movement of the rolling apparatus can be mounted on the sides, as well as, the front and rear ends of the elongate body portion. The means for controlling the movement of the rolling apparatus include, but are not limited to, a steering means, a braking means and a means for preventing the backward movement of the rolling apparatus.

Figure 2:
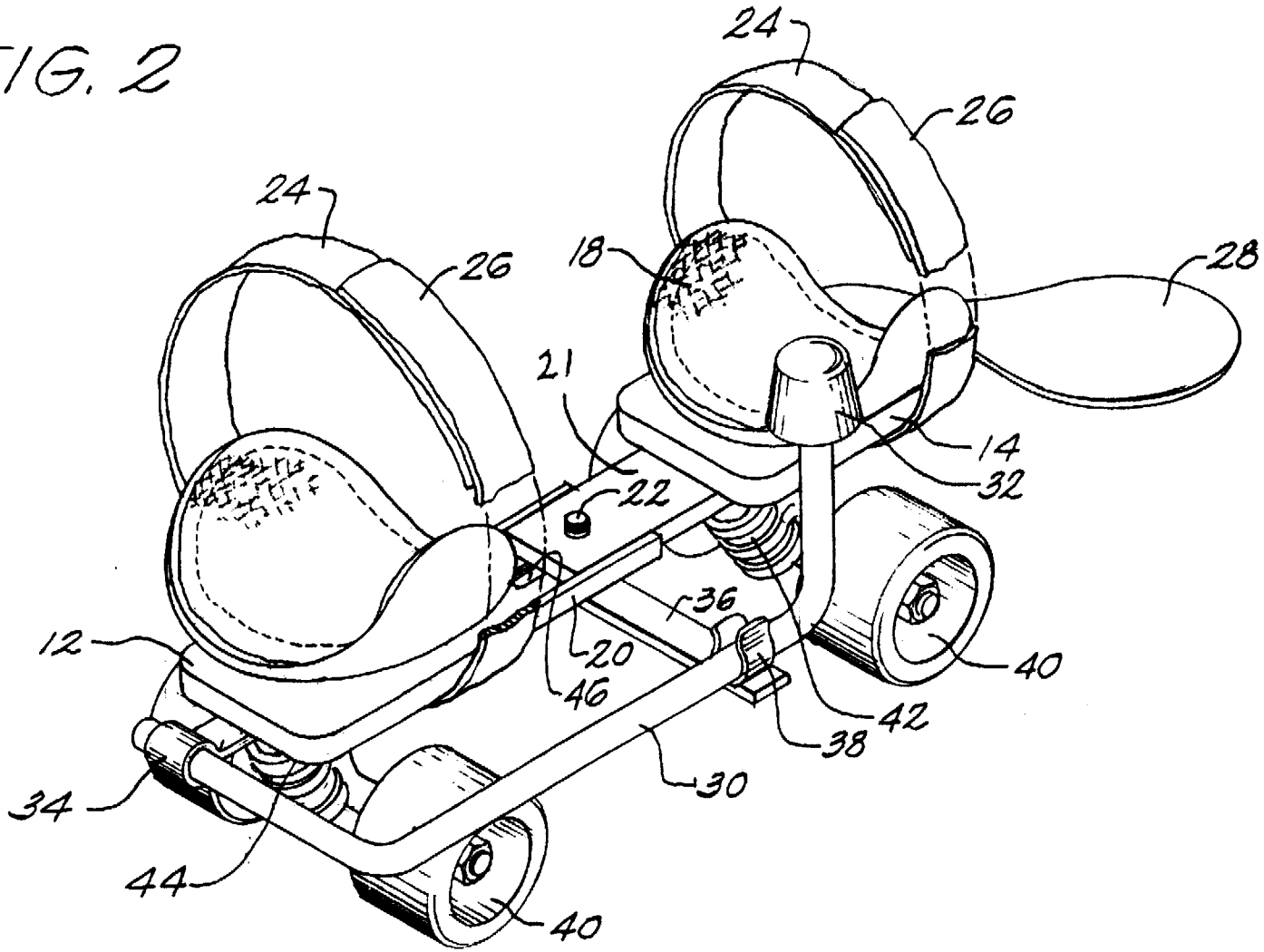
Figure 3:
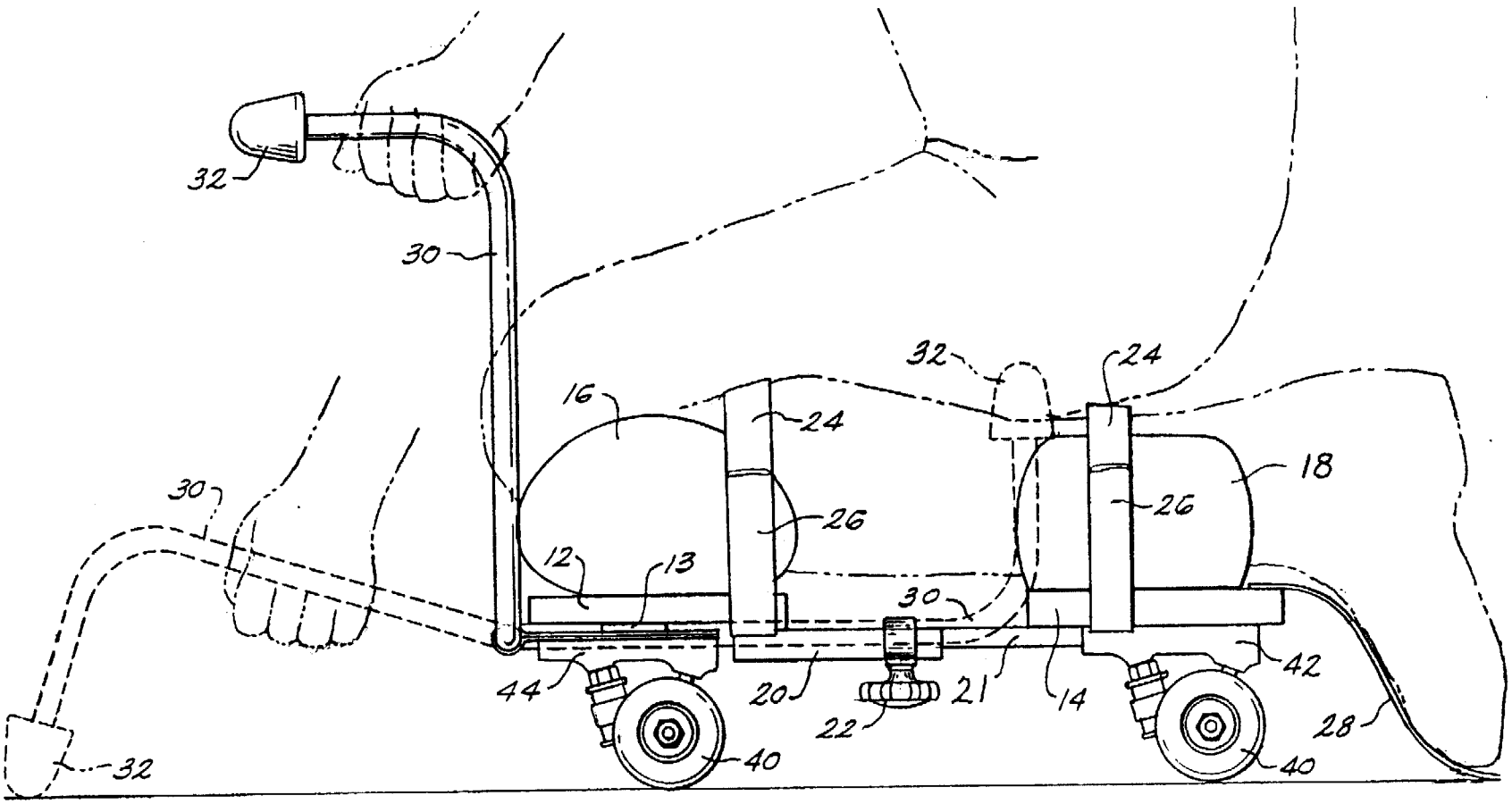
Figure 4:
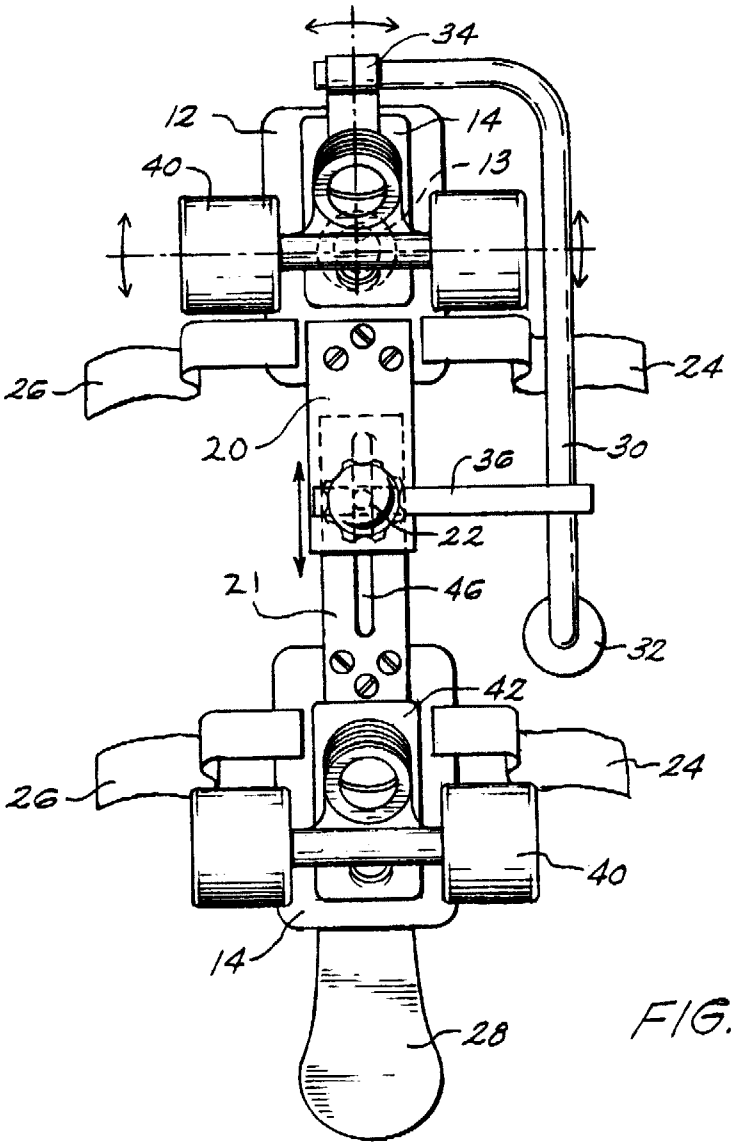

The elongate body portion can be adjustable in length. The adjustable embodiment of the elongate body portion is typically comprised of two or more movable parts which can be unfastened for adjustment longer or shorter and fastened for securement to a particular length. An adjustable embodiment of the elongate body portion can include a portion comprised of two separate parts with notched holes which are matched, fitted and fastened together with a perpendicular bolt passing through the matched, fitted holes of each respective part of the elongate body portion. Alternatively, the adjustable elongate body portion may be adjusted with a screwable knob within a cavity between two separate movable parts comprising the elongate body portion as illustrated in FIGS. 2, 3 and 4.

Roller Trucks

Secured to the underside of the elongate body portion by means such as bolts are a plurality of roller trucks. Each of the roller trucks can be of a type commonly used in conventional roller skates or skateboards and comprise a pair of rollers rotatably mounted on an axle supported by an arm and a conventional cushioning assembly connected to a base plate which in turn is secured to the elongate body portion by bolts.

The roller trucks can be secured in place to allow simple back and forth movement or they can be mounted with the use of a washer to allow lateral, rotational movement by a steering device. Roller trucks also can be comprised of rollers which rotate 360 degrees, allowing not only back and forward movement, but virtually any movement in a lateral direction (i.e., sideways and diagonally) which can be useful in a working environment.

Means for Securement to the Lower Leg

The means for securement of the rolling apparatus to the lower leg of an individual or operator can be by any means which mechanically attaches the elongate body portion of the rolling apparatus to the lower leg or shin of an individual. Belted or VELCRO™ hook and loop fastener treated straps or any material forming a tough, flexible, continuous band can be used at points perpendicular to the length of the elongate body portion which surround the lower leg and effectuate securement or attachment of the apparatus to the lower leg. Straps can be comprised of cloth, plastic or leather and can be of varying width and length.

Padding Apparatus

The padding apparatus can be any cushion-like mass of soft material used for filling and for protection against jarring, scraping or other injury that may have been caused by the absorption of shock against the lower leg of an operator of the rolling apparatus. The padding apparatus can be comprised of material of a type commonly used in conventional shin guards. Alternatively, the pad can be comprised of an enclosable sleeve which can be filled to varying amounts and heights of soft material, depending on the preferences of the rolling apparatus operator.

Means for Controlling Movement

There are two basic means of controlling the movement of the rolling appartus, braking and steering. A braking means for the rolling apparatus can be any mechanical device or apparatus attached to the roller trucks or elongate body portion of the rolling apparatus which when operable, arrests or prevents motion usually by means of friction. Examples of such braking means include a foot pad comprised of rubber, leather or some other friction promoting material attached at the rear end of the elongate body portion which is engaged by the downward pressure of the operators foot against the pad causing friction between the pad and the pavement over which the apparatus is rolling. The foot pad can be constructed such that the foot of the operator rests on top of the pad or partially fits within the pad. Another example includes a lever which can be engaged by the hand of an operator depressing a component of the lever which is comprised of rubber or some other friction promoting material against the pavement.

A steering means for the rolling apparatus can be any device or apparatus which is attached to a front roller truck that has been mounted to the elongate body portion to allow lateral rotational movement. The steering means is engaged by the operator moving the steering device in the direction of desired movement. An example of such a device can be a metal bar.

Although attached at one end to the rolling apparatus, the braking and steering means can be temporarily secured at another position while not in operation by a clamping device which holds the braking and steering means in place.

Perferred Embodiment(s) of the Present Invention

Figure 1B:
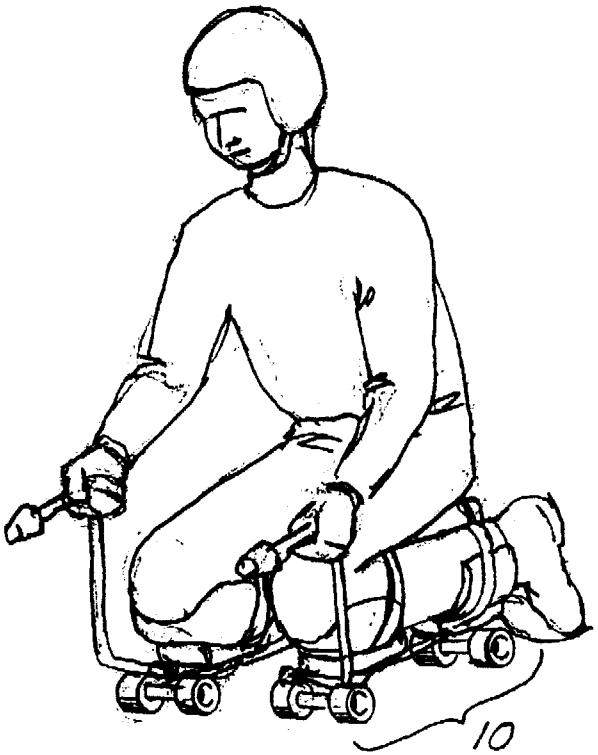
Figure 1A:
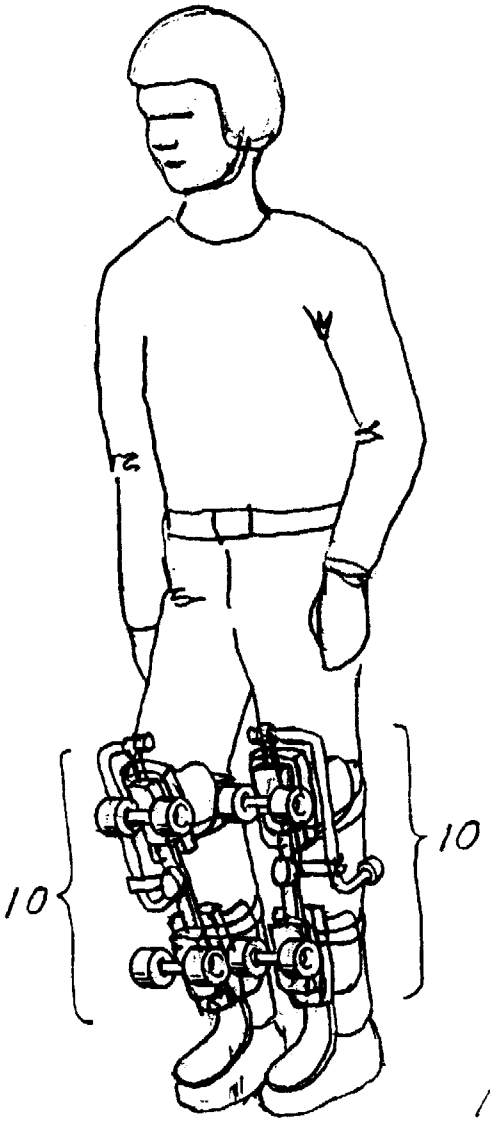

The perferred embodiment(s) of the present invention relates to a rolling apparatus used in attachment to a lower leg of an individual or operator. The perferred embodiment (s) is illustrated in FIGS. 1 thru 5. As illustrated in FIG. 1, the rolling apparatus is attached to an operator. FIG. 1A illustrates the ability of an operator to walk while still wearing the rolling apparatus. FIG. 1B illustrates the apparatus in operation.

Figure 5:
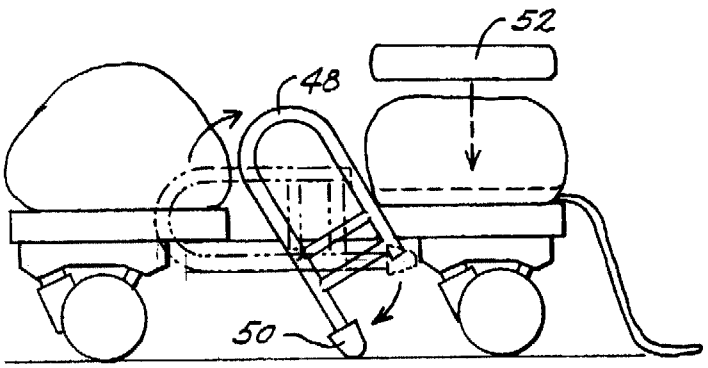

In FIGS. 2, 3 and 4, the rolling apparatus is illustrated in detail. The elongate body portion (#12, #14, #20 and #21 together, #20 is secured to #12 by screws and #21 is secured to #14 by screws) is comprised of an adjustable platform with a front end (#12) and a rear end (#14). The rear end can be of varying height for individuals with larger or smaller feet, so as to provide the proper elevation of the feet off of the rear end. The upper surface of the front and rear ends each have a padding apparatus attached (#16 and #18, respectively). Roller trucks (#40 with conventional cushioning assemblies #44 and #42) are attached to the underside of the front and rear ends of the elongate body portion (#12 and #14, respectively). The securing means of the rolling apparatus is comprised of two sets of straps (each set being #24 and #26 together). One set of straps encompass the front end and the other set encompasses the rear end of the rolling apparatus. The steering means is comprised of a metal bar (#30) that is attached to the front roller truck (#40 with conventional cushioning assembly #44) by a clamp (#34). A washer (#13) positioned between the elongate body portion and the front end roller truck allows for the lateral rotational movement of the front end roller truck. The steering means is secured in place when not in operation by another clamp (#38) which is attached to the elongate body portion by a metal bar (#36). There are two braking means illustrated; one is a rubber knob attached to the steering means (#32) and is engaged as illustrated in FIG. 3. The other braking means is a foot pad (#28) engaged by the downward pressure of the operator's foot. The elongate body portion is adjustable in length by unfastening a screwable knob (#22) and moving the parts (#20 and #21) together or apart through the cavity (#46) and then fastening or tightening the screwable knob to the desired length. An alternate means of braking is illustrated in FIG. 5 where a metal bar is engaged and a rubber tip (#50) is pressed against the pavement. Additional padding (#52) also is illustrated in FIG. 5. Additional padding can be a used to heighten or lower the rear end of the elongate body portion for individuals with larger or smaller feet.

Equivalents

Those skilled in the art will recognize, or be able to acertain using no more than routine experimentation, many equivalents to the specific embodiments of the invention described specifically herein. Such equivalents are intended to be encompassed in the scope of the following claims.

I claim:

1. A rolling apparatus for use in securement to a lower leg of a person comprising:

a) an elongate body portion with an upperside and an underside, front and rear ends, and presenting planar upper and lower surfaces;

b) a plurality of roller trucks secured to the underside of said body portion, positioned adjacent opposite front and rear ends thereof; and c) a means for securing said planar upper surface of said elongate body to a lower leg of said person.

2. A rolling apparatus of claim 1 wherein said rolling apparatus comprises a means attached to said elongate body portion for braking the motion of said rolling apparatus.

3. A rolling apparatus of claim 2 wherein said braking means comprises a foot pad attached to the rear end of said elongate body portion.

4. A rolling apparatus of claim 2 wherein said braking means comprises a hand brake attached to the side of said elongate body portion.

5. A rolling apparatus of claim 1 wherein said rolling apparatus comprises a means attached to the front end of said elongate body portion for steering the direction of said rolling apparatus.

6. A rolling apparatus of claim 1 wherein said elongate body portion of said rolling apparatus comprises a means for changing the length of said elongate body portion by positioning and fastening the front and rear ends together.

7. A rolling apparatus of claim 1 wherein said upper planar surface of said elongate body comprises an attached padding apparatus.

8. A rolling apparatus of claim 1 wherein said means for securing said upper planar surface of said elongate body to a lower leg of said person comprising an adjustable wrap secured to said elongate portion.

9. A rolling apparatus of claim 8 wherein said adjustable wrap is comprised of four like, elongated, flexible straps.

* * * * *